US006240808B1

(12) United States Patent
Gelbard

(10) Patent No.: US 6,240,808 B1
(45) Date of Patent: Jun. 5, 2001

(54) CORK EXTRACTOR

(76) Inventor: Martin K. Gelbard, 13859 Magnolia, Sherman Oaks, CA (US) 91423

( * ) Notice: Subject to any disclaimer, the term of this patent is extended or adjusted under 35 U.S.C. 154(b) by 0 days.

(21) Appl. No.: 09/352,894

(22) Filed: Jul. 13, 1999

Related U.S. Application Data

(60) Provisional application No. 60/114,685, filed on Jan. 4, 1999.

(51) Int. Cl.[7] ..... B67B 7/44

(52) U.S. Cl. ..... 81/3.09; 15/212; 81/3.41

(58) Field of Search ..... 81/3.07, 3.09, 81/3.41; 294/86.11, 86.17, 86.2, 86.24, 86.31, 86.32, 93, 99.1, 99.2; 15/211, 212; 210/470, 471

(56) References Cited

U.S. PATENT DOCUMENTS

| | | | | |
|---|---|---|---|---|
| 47,161 | | 4/1865 | Bielefield et al. . | |
| 72,247 | | 12/1867 | Waterman . | |
| 78,513 | * | 6/1868 | Button | 81/3.07 |
| 120,830 | | 11/1871 | Simpers . | |
| 140,706 | | 7/1873 | Hunt . | |
| 199,760 | | 1/1878 | Tyrer . | |
| D. 244,002 | | 4/1977 | Bonin | D8/42 |
| D. 252,972 | | 9/1979 | Essing | D8/42 |
| D. 290,682 | | 7/1987 | Rogers | D8/42 |
| 336,746 | * | 2/1886 | Reisor | 15/211 |
| 777,380 | | 12/1904 | Kennedy . | |
| 791,497 | * | 6/1905 | Putnam | 15/211 |
| 852,748 | * | 5/1907 | True | 15/211 |
| 889,474 | | 6/1908 | Medley . | |
| 983,778 | | 12/1911 | Sersen . | |
| 2,634,497 | | 4/1953 | Waldesbuehl | 30/142 |
| 2,895,357 | | 7/1959 | Perez | 81/3.34 |
| 2,939,216 | | 6/1960 | Armstrong | 30/324 |
| 3,800,345 | | 4/1974 | Feliz | 7/14.6 |
| 3,967,512 | | 7/1976 | Soldano | 81/3.34 |
| 4,253,351 | | 3/1981 | Allen | 81/3.38 A |
| 4,276,789 | | 7/1981 | Allen | 81/3.36 |
| 4,291,567 | | 9/1981 | Murayama | 72/347 |
| 4,377,096 | | 3/1983 | Allen | 81/3.38 A |
| 4,429,444 | | 2/1984 | Allen | 29/33 F |
| 4,446,980 | | 5/1984 | Oliver et al. | 215/276 |
| 4,574,663 | | 3/1986 | Delisle, Jr. | 81/3.48 |
| 4,679,467 | | 7/1987 | Delnero | 81/3.07 |
| 4,680,993 | | 7/1987 | Feliz | 81/3.37 |
| 4,765,206 | | 8/1988 | Poehlmann | 81/3.37 |
| 4,791,834 | | 12/1988 | Federighi | 81/3.2 |
| 4,836,060 | | 6/1989 | Klefbeck | 81/3.29 |
| 4,969,368 | | 11/1990 | Sekine et al. | 74/54 |
| 5,134,906 | * | 8/1992 | Sit | 81/3.09 |
| 5,253,553 | | 10/1993 | Mothershead | 81/3.48 |
| 5,299,408 | | 4/1994 | Dupont | 53/432 |
| 5,372,054 | | 12/1994 | Federighi, Sr. | 81/309 |
| 5,417,860 | * | 5/1995 | Kay | 210/472 |
| 5,636,757 | | 6/1997 | Porvaznik | 215/364 |

FOREIGN PATENT DOCUMENTS

| | | | | |
|---|---|---|---|---|
| 943781 | | 4/1974 | (CA) | 63/83 |
| 339671 | * | 8/1921 | (DE) | 81/3.4 |
| 499727 | | 2/1920 | (FR) | 81/3.49 |
| 668912 | | 11/1929 | (FR) | 81/3.34 |
| 929819 | | 1/1948 | (FR) | 81/3.49 |
| 4242 | * | of 1876 | (GB) | 81/3.07 |
| 27343 | | of 1905 | (GB) | 81/3.4 |
| WO 88/03512 | * | 5/1988 | (WO) | 81/3.09 |

* cited by examiner

*Primary Examiner*—James G. Smith
*Assistant Examiner*—David B. Thomas
(74) *Attorney, Agent, or Firm*—Sheldon & Mak

(57) ABSTRACT

An extractor for removing a cork from the inside of a main body of a narrow neck bottle comprises a handle, and at least two generally oval wire loops depending from the handle, the wire loops being deformable so they can fit through the neck and expand and capture a cork. Optionally mesh is provided with the loops for extracting cork fragments. The mesh can be held in place by interlocking the loops together.

26 Claims, 5 Drawing Sheets

CORK EXTRACTOR

CROSS-REFERENCE

This is a continuation-in-part application of provisional application Ser. No. 60/114,685 filed Jan. 4, 1999, which is incorporated herein by reference.

BACKGROUND

The present invention relates to a tool for removing a cork and cork pieces floating in a narrow neck bottle.

Corks being broken in the neck of a bottle during removal, for example, by a corkscrew, is an extremely common problem. Generally, in this situation, the user pushes the cork and the cork pieces down into the bottle where they remain while the contents of the bottle are emptied.

Although it is possible to pour wine and other beverages from a bottle with a cork floating in it, often cork pieces end up in the beverage. Further, the floating cork can provide an impediment against pouring the beverage from the bottle, frequently leading to spillage. Moreover, for commercial applications, such as restaurants, it is generally not acceptable to serve an expensive bottle of wine with cork pieces floating in the wine.

Attempts have been made to design tools for removing trapped intact corks from bottles, such as those described in Delnero U.S. Pat. No. 4,679,467; Sersen U.S. Pat. No. 983,778; Tyrer U.S. Pat. No. 199,760; and Simpers U.S. Pat. No. 120,830. These tools generally utilize one or more elongated loops, which compress into a size small enough to fit into a bottle neck, expand in the main body of the bottle, and loop around a broken cork for withdrawal through the neck.

Under certain circumstances, these cork pulling devices can be effective, but they also suffer disadvantages. For example, those with a single loop are difficult to center around a floating cork. Simpers and Tyrer use multiple loops, but they are attached together at their ends, which makes them difficult to manipulate around a cork. The Delnero device utilizes a strap, which is rigid and difficult to pull the cork through a narrow neck, the strap creating a significant resistance to the pulling motion. Moreover, none of these devices is effective in removing small pieces of broken cork from a bottle, all being directed to removal of substantially intact corks.

Accordingly, there is a need for a cork extractor that can be used for removing corks and small cork pieces floating in the main body of a narrow neck bottle, where the extractor is easily manipulated and easily used.

SUMMARY

The present invention is directed to a cork extractor that satisfies these needs. The cork extractor is designed for removing a cork and/or cork pieces from the inside of the main body of a bottle having a narrow neck into which the intact cork can snugly fit. The extractor comprises a handle and at least two generally oval loops depending from the handle. Each loop has a long axis and a short axis, and defines a plane, the planes being transverse to each other. The loops form a cage into which a cork can fit. The loops have a non-deformed configuration and a deformed configuration. In the non-deformed configuration the short axis of the loops is larger than the diameter of the neck of the bottle, and typically is less than the diameter of the main body of the bottle. The loops are sufficiently flexible and sufficiently strong that they can be compressed into their deformed configuration and inserted into the bottle through the neck. In the deformed configuration, the short axis of the loops is smaller than the diameter of the neck of the bottle.

Preferably the loops are formed of wire circular in cross-section. The wire can have a diameter of about 0.04 inch. Preferably the distal ends of the loops are not secured to each other, but do contact each other in the non-deformed and deformed configurations. Optionally, the distal ends can be removably interlocked in a manner that allows each to retain its flexibility. This makes it easier to manipulate the device to encompass a cork than with the multiple loop prior art devices discussed above.

Preferably the extractor includes a flexible mesh at the distal ends of the loops for removing cork pieces from the bottle. The flexible mesh can be attached to the loops at the distal ends, or can be attached to the handle.

Thus, the present invention provides a cork extractor that is easy to use, and can be used for extracting intact corks as well as small pieces of cork from a narrow neck bottle.

DRAWINGS

These and other features, aspects and advantages of the present invention will become better understood with reference to the following description, appended claims, and accompanying drawings where:

DESCRIPTION

Figure 1:
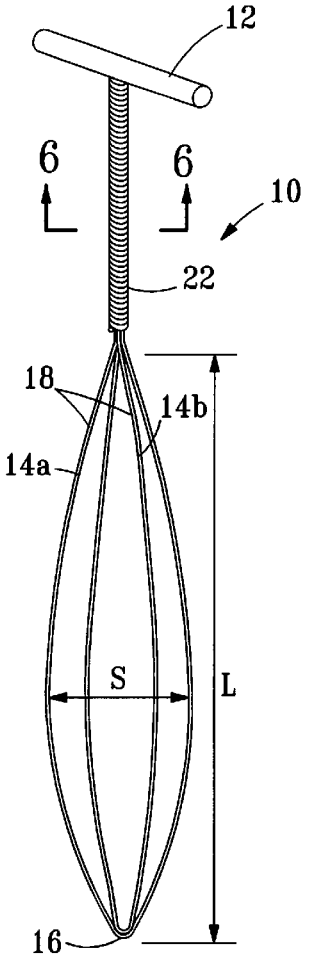
FIG. 1 is a perspective view of a cork extractor according to the present invention in a non-deformed configuration.
Figure 6:
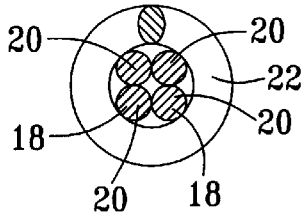
FIG. 6 is a sectional view of the extractor of FIG. 1 taken on line 6—6 in FIG. 1.

With reference to FIGS. 1 and 6, an extractor 10 according to the present invention comprises a handle 12, and depending from the handle two loops 14*a* and 14*b*. Each loop includes a section 16 proximal to and attached to the handle 12, and a distal end 16.

The loops are shown in FIG. 1 in a non-deformed, at rest configuration. The distal ends 16 of the loops are not secured to each other, but do contact each other at their distal ends 16. The loops 14 define planes which are transverse to each other, and in the version of the invention shown in FIG. 1, comprising two loops, are perpendicular to each other.

The loops 14 are preferably made of wire that is circular in cross-section, with a diameter from about 0.01 to about 0.1 inch, and most preferably about 0.04 inch. It has been determined that this size of wire allows easy removal from a bottle, even when a cork is caged by the loops.

Preferably each loop 14 is made by a single strand of wire 18, and both ends 20 of the wire are attached to the handle 12. The attachment can be effected by welding, adhesive, or mechanical attachments, such as by having the wires extend through a hole (not shown) in the handle and tied off or crimped in place. The portions of the wire proximal to the handle are in close proximity to each other, and preferably enclosed in a coil spring 22, the coil spring 22 improves the aesthetics of the product, and allows formation of loops 14 of desired size, while allowing the extractor to having a length adequate for removing corks from bottle.

Each loop is generally oval in shape, with a short axis S and a long axis L. Preferably the short axis S is from about 4 to 5 centimeters, and most preferably about 4.5 centimeters. Preferably the long axis L is from about 17 to about 19 centimeters, and most preferably about 18.3 centimeters. These dimensions are with regard to the non-deformed configuration of the extractor 10 as shown in FIG. 1. These dimensions provide a "cage" into which a cork can fit, wherein the short axis is larger than the typical diameter of the neck of a wine bottle, and most other narrow neck bottles that utilize a cork. Also, these dimensions allow the loops to expand to their non-deformed configuration inside the main body of a typical wine bottle. In other words S is less than the diameter of the main body of a typical wine bottle and L is less than the long axis of the main body portion of a typical wine bottle.

Figure 3:
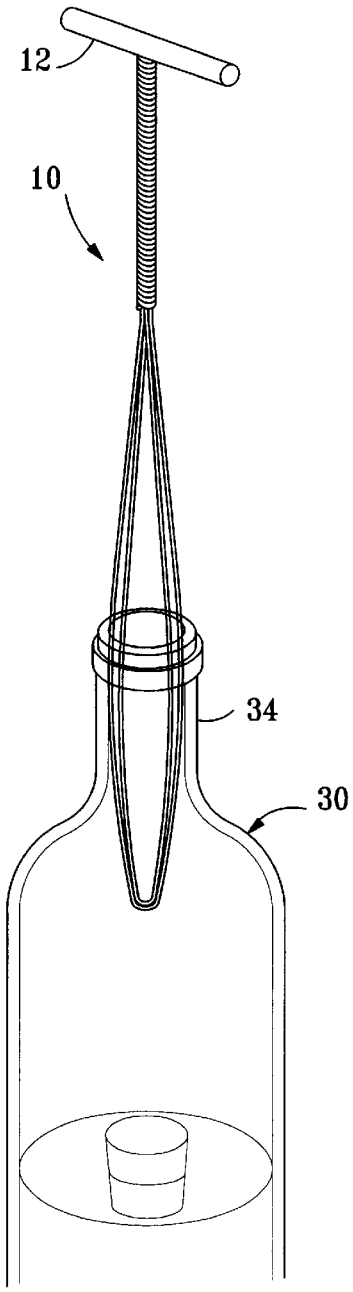
FIGS. 3–5 show the sequential steps of utilizing the extractor of FIG. 1 to remove the cork from the bottle of FIG. 2.

Preferably the loops are formed of wires sufficiently flexible and sufficiently strong that the loops can be compressed and elongated, as shown in FIG. 3, to fit into the neck of a bottle. Preferably, the overall length of the extractor 10 is from about 25 to about 27 centimeters, and preferably about 26 centimeters, including the portions contained within the coil spring 22. Most preferably the coil spring is about 7.5 centimeters long. These dimensions allow the loops 14 to be completely inserted into a bottle, where they can expand back into the non-deformed configuration for caging a floating cork. Thus, the coil spring and the non-loop portions of the wire contribute to the desired overall length of the extractor, without unduly changing the basic configuration of the loops 14. By using a coil spring to enclose the top portion of the wires forming the loops, a reversible deflection of the portions of the wire proximal to the handle can occur, thereby contributing to the ease of use of the extractor.

The handle 12 in the version shown in FIG. 1 is a cylindrical piece of metal easily gripped. If desired the handle 12 can be made of a sufficiently large diameter and sufficient length to force a broken cork into a bottle for extraction.

The extractor 10 can be formed of any material that is sanitary, and has a sufficient combination of strength and flexibility, such as plastics and metals. Preferably it is formed of stainless steel. More preferably the stainless steel is 302 stainless steel wire, and preferably the extractor 10 when formed of this material is heat-treated at about 600° F. for thirty minutes after assembly for stress relief.

Figure 2:
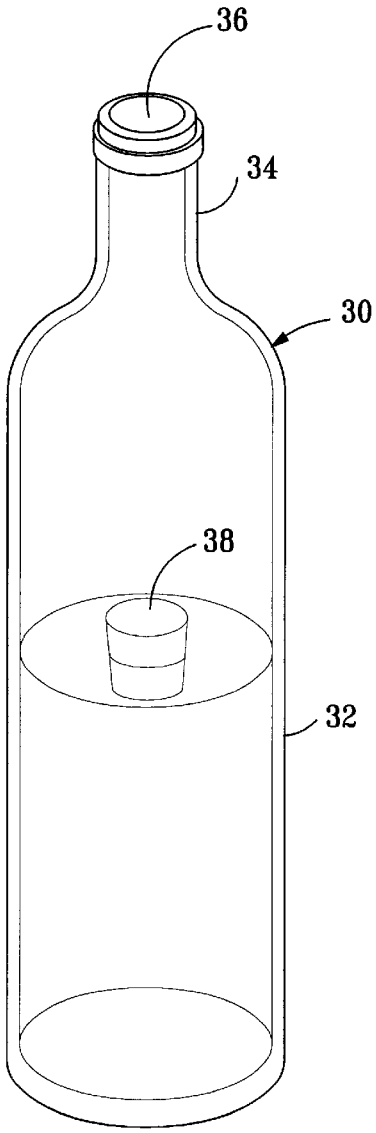
FIG. 2 is a perspective view of a narrow neck bottle having a cork floating therein.

Use of the extractor 10 is demonstrated with regard to FIGS. 2–5. FIG. 2 shows a bottle 30 having a main body portion 32, a narrow neck 34, and a top opening 36 which once held a cork 38, which is now floating in liquid in the bottle. As shown in FIG. 3, in the first step of removal of the cork, the loops 14 of the extractor 10 are inserted through the opening 36 and into the neck 34 of the bottle 30. The contours of the neck 34 and a downward force on the loops by a person pushing downwardly on the handle 12 causes the loops to go into the deformed configuration shown in FIG. 3.

Figure 4:
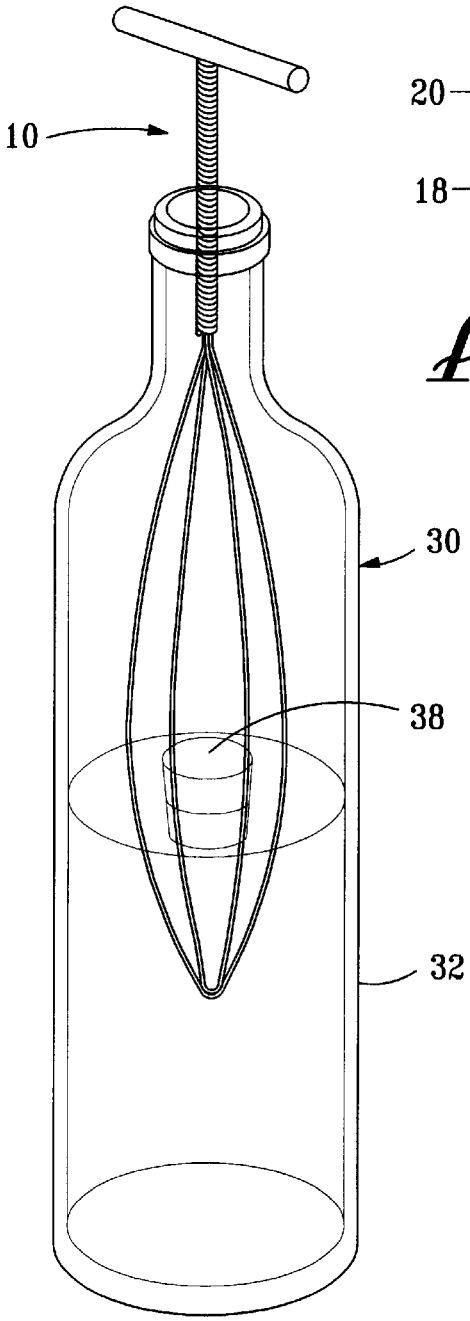
Figure 5:
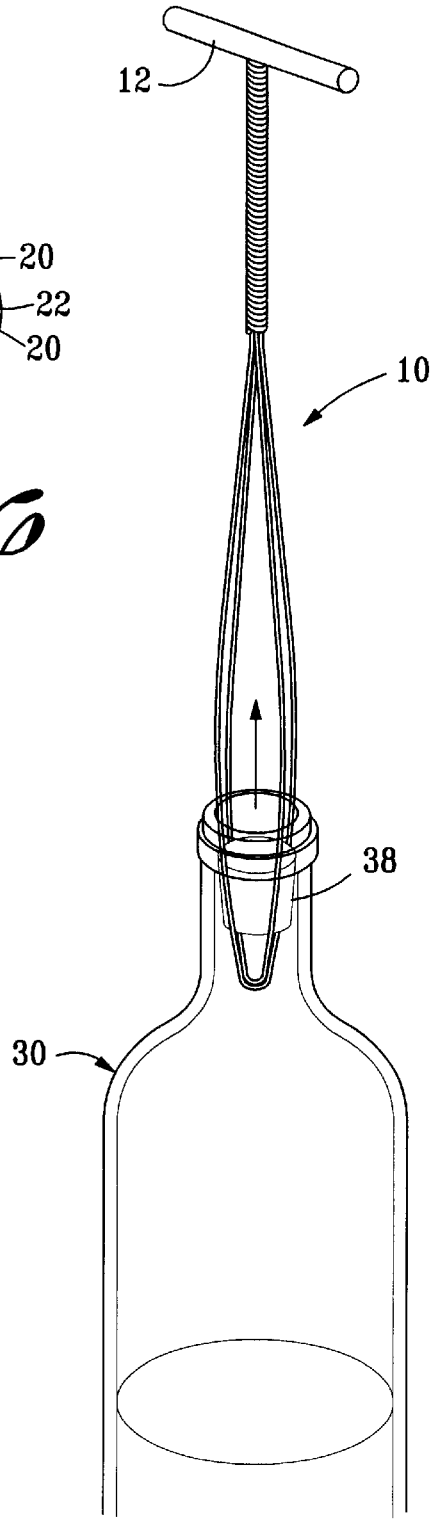

Once the loops 14 are into the main body 32 of the bottle they resiliently spring back to the non-deformed configuration, as shown in FIG. 4, and can easily be manipulated to enclose the cork 38. The cork 38 is then easily removed from the bottle by pulling upwardly on the extractor with the handle 12 as shown in FIG. 5, thereby removing the caged cork 38.

Encasing of the cork is easily effected because the distal ends 16 of the loops are not secured together. Moreover, removal of the cork 38 is easily effected because the loops are formed of a small diameter wire that is circular in cross-section, providing minimal surface contact with the walls of the neck of the bottle, thereby minimizing the frictional resistance to removal of the cork.

In an optional version of the invention, the extractor 10 can be provided with mesh material for removal of small cork fragments from a bottle. The mesh material can either be provided with the extractor as part of a kit for attachment to the extractor by the user, or the extractor and mesh can be provided preassembled.

The mesh material needs to be sufficiently flexible that it can assume both the deformed and non-deformed configurations of the loops 14. It needs to be of sufficiently large mesh size that resistance to removal from the bottle is not significantly increased, but it needs to be of sufficiently small mesh size that substantially all pieces of cork floating in a bottle can be removed.

Among the materials that can be used include cheese cloth, coffee filter material, and preferably a type of nylon mesh, known as tulle, used for bridal veils. Preferably the mesh has an opening size of from about 1 to about 2 mm, and most preferably about 1.4 mm.

A variety of techniques can be used for providing the mesh with the extractor 10.

Figure 7A:
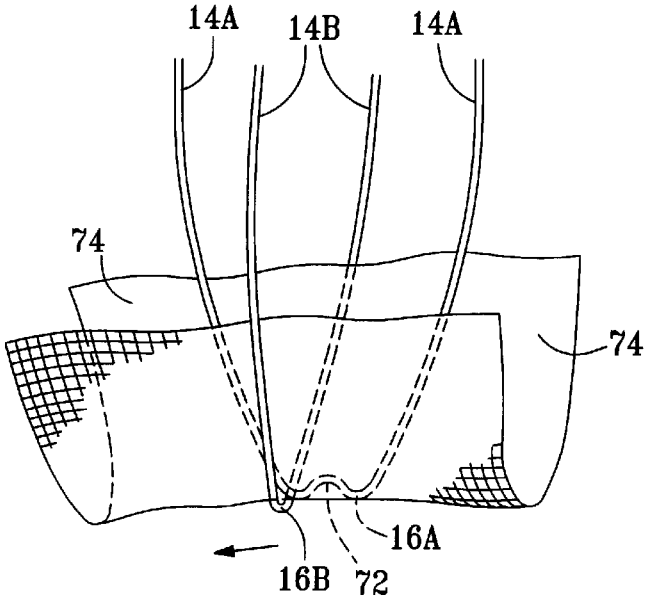
FIGS. 7A–7E show the extractor of FIG. 1 modified by holding mesh material for extracting broken cork pieces from the bottle, and being utilized to remove cork pieces.
Figure 7B:
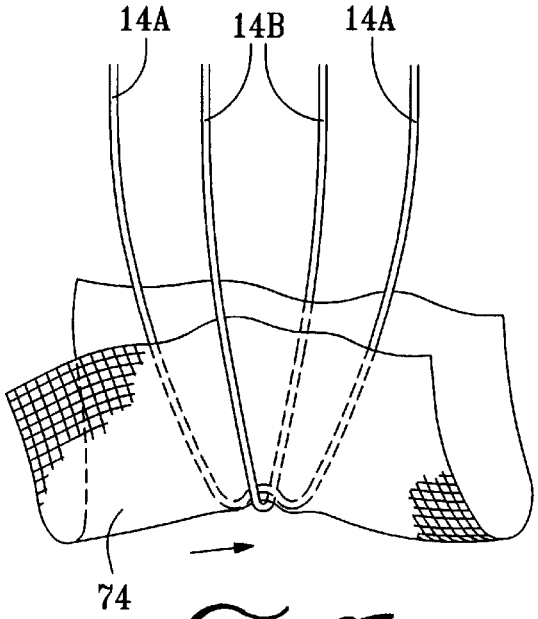

For example, in the version of the invention shown in FIG. 7A, the distal end 16*a* of wire 14*a* can be provided with a detent 72 in which the distal end 16*b* of wire 14*b* can retainly fit. Mesh material 74 is placed around the exterior loop 14*a,* and then is held in place by loop 14*b,* effectively snap-fitting into the detent 72, as shown in FIG. 7B. Thus, the loops 14*a* and 14*b* are reversibly interlocked at their distal ends.

Figure 7C:
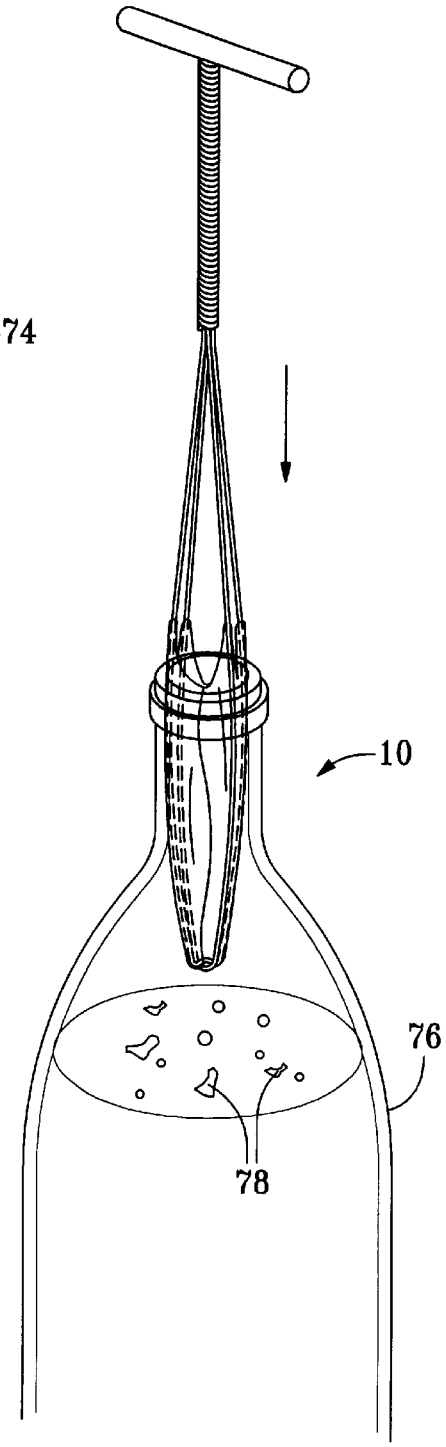
Figure 7D:
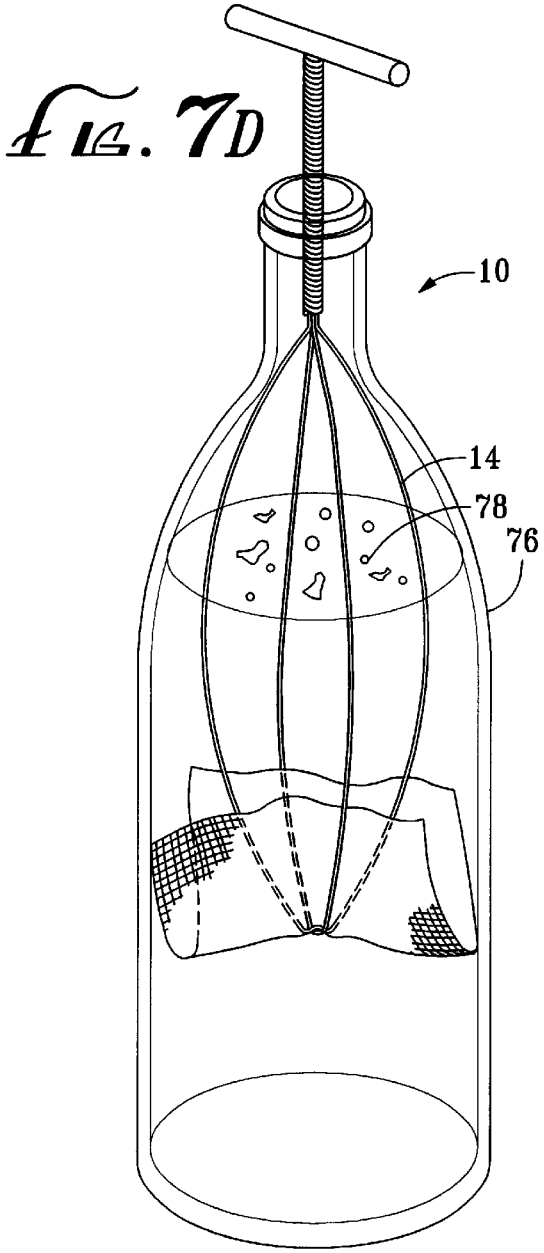
Figure 7E:
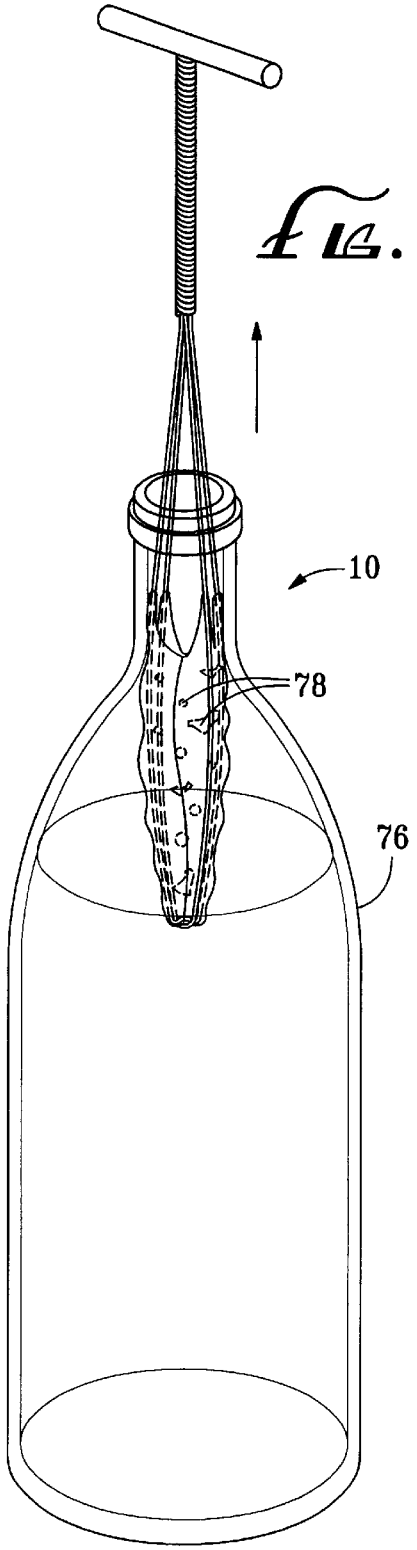

As shown in FIG. 7C, the extractor 10 with mesh material 74 held by the loops 14 is introduced into a bottle 76 having a relatively small cork pieces or cork debris 78 floating therein. When the extractor 10 is inserted into the bottle 76 a sufficient amount that the loops 14 are in the main body portion, they expand to a non-deformed configuration, as shown in FIG. 7D, with the mesh in the general shape of an upside down umbrella. As shown in FIG. 7E, by pulling the extractor out through the neck of a bottle, the cork pieces 78 are trapped and removed form the liquid contents of the bottle 76.

Figure 8:
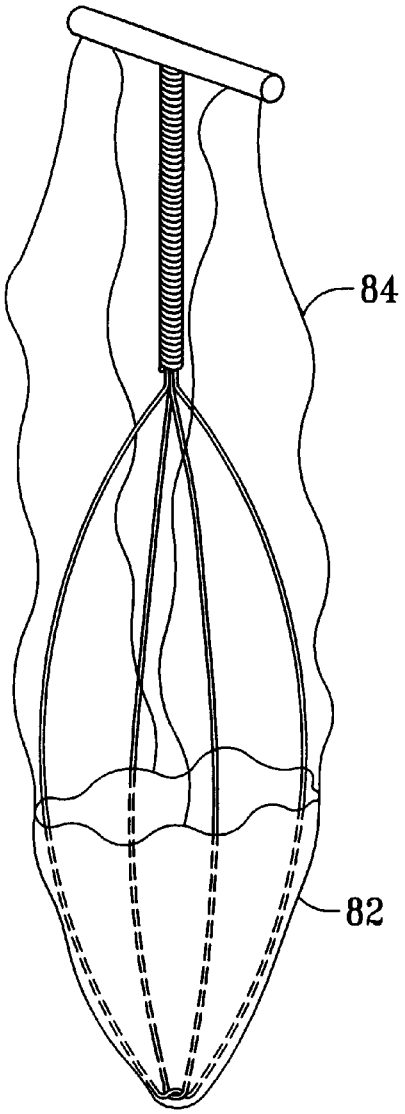
FIG. 8 shows another version of the present invention utilizing mesh, where the mesh material is attached to the handle of the extractor.

In the version of the invention shown in FIG. 8, a coffee filter type mesh 82 is provided in the form of an upside down parachute, with upwardly extending strings 84. The strings 84 are secured to the handle.

Figure 9:
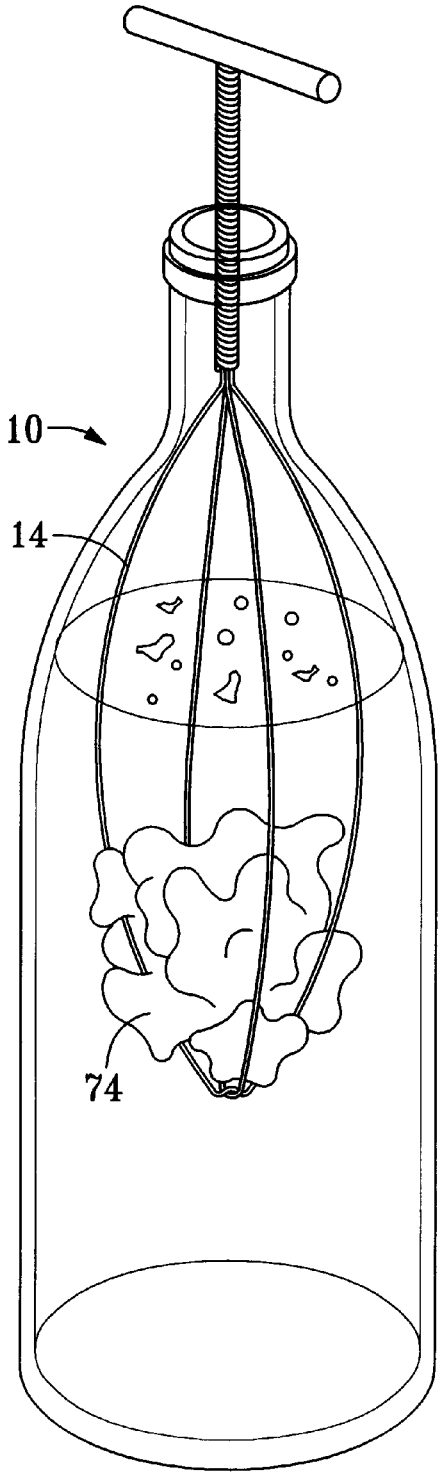
FIG. 9 shows another version of the invention utilizing mesh.

As shown in FIG. 9, cheese cloth material 92 can be inserted in the cage formed by the loops 14, and held in place with no retention means other than that provided by the loops.

Thus, the mesh material can be provided inside the cage formed by the loops, or can be on the exterior of one or both of the loops. Preferably the filter material is easily removable so that the extractor can be used both for removing substantially unbroken corks, and small pieces of cork.

Although the present invention has been described in considerable detail with reference to certain preferred versions thereof, other versions are possible. For example, the handle 12 can have a compartment such as being made hollow to store nylon mesh 74 therein. Also, the loops interlocked as shown in FIGS. 7A–7E can be used without mesh. In addition, it is possible to support mesh with a single loop rather than multiple loops. Therefore, the spirit and scope of the appended claims should not be limited to the description of the preferred versions contained herein.

All features disclosed in the specification, including the claims, abstracts, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

Also, any element in a claim that does not explicitly state "means" for performing a specified function or "step" for performing a specified function, should not be interpreted as a "means" or "step" clause as specified in 35 U.S.C. §112.

What is claimed is:

1. An extractor for removing a cork from a bottle, the bottle having a narrow neck and a main body in which the cork is floating, the extractor comprising:

a) a handle; and b) at least two generally oval loops depending from the handle and forming a cage into which the cork can fit, the loops comprising an end proximal to the handle and a distal end, the distal ends of the loops being unattached to each other, the loops having substantially the same size and configuration, each loop having a long axis and a short axis and defining a plane, the planes being transverse to each other, the loops having a non-deformed configuration, the short axis of the loops being larger than the diameter of the neck in the non-deformed configuration, the loops being formed of wire sufficiently flexible and sufficiently strong that the loops can be compressed into a deformed configuration that allows their insertion into the bottle through the neck, the loops being formed of wire substantially circular in cross-section.

2. An extractor for removing a cork from a bottle, the bottle having a narrow neck and a main body in which the cork is floating, the extractor comprising:

a) a handle; and b) first and second generally oval loops depending from the handle and forming a cage into which the cork can fit, each loop comprising an end proximal to the handle and a distal end, the distal end of the first loop having a detent into which the distal end of the second loop is removably interlocked, wherein removal of the second loop from the detent results in the distal ends of the loops being unattached to each other, the loops having substantially the same size and configuration, each loop having a long axis and a short axis and defining a plane, the planes being transverse to each other, the loops having a non-deformed configuration, the short axis of the loops being larger than the diameter of the neck in the non-deformed configuration, the loops being formed of wire sufficiently flexible and sufficiently strong that the loops can be compressed into a deformed configuration that allows their insertion into the bottle through the neck, the loops being formed of wire substantially circular in cross-section.

3. The extractor of claim 1 wherein the distal ends of the loop contact each other in both the non-deformed configuration and the deformed configuration.

4. The extractor of claim 1 having only two loops, and wherein the planes are substantially perpendicular to each other.

5. The extractor of claim 1 wherein the wire is made of stainless steel.

6. The extractor of claim 1 wherein the wire is circular in cross-section and has a diameter of about 0.04 inch.

7. The extractor of claim 2 wherein the wire is circular in cross-section.

8. The extractor of claim 2 wherein the long axis of the loops is from about 11 to about 13 inches.

9. The extractor of claim 1 or 2 wherein each loop is formed of a single strand of wire attached to the handle, and the extractor includes a coil spring around the wire proximal to the handle.

10. An extractor capable of removing a cork and cork pieces from the inside of a bottle, the bottle having a narrow neck, the extractor comprising:

a) a handle;

b) one or more loops depending from the handle and forming a cage into which a cork can fit, each loop comprising a distal end, each loop having a long axis and a short axis and defining a plane, the loops having a non-deformed configuration, the short axis of each loop being larger than the diameter of the neck in the non-deformed configuration, each loop being sufficiently flexible and sufficiently strong that it can be compressed into a deformed configuration that allows its insertion into the bottle through the neck; and c) flexible mesh at the loop distal end for removing cork pieces from the bottle.

11. The extractor of claim 10 comprising at least two loops, the planes of the loops being transverse to each other.

12. The extractor of claim 11 wherein the distal end of one of the loops has a detent into which the distal end of another loop can be removably interlocked.

13. The extractor of claim 11 wherein the mesh material is cheese cloth.

14. The extractor of claim 11 wherein the mesh material is nylon mesh.

15. The extractor of claim 11 wherein the mesh material has openings of from about 1 to about 2 mm.

16. The extractor of claim 11 wherein the mesh is within the cage.

17. The extractor of claim 11 wherein the loops include first and second loops, and the mesh is exterior to the first loop and inside the second loop.

18. The extractor of claim 17 wherein the mesh is crimped between the distal ends of the first and second loops.

19. The extractor of claim 11 wherein the mesh is crimped between the distal ends of two loops.

20. The extractor of claim 11 wherein the mesh is attached to the handle.

21. The extractor of claim 11 wherein the mesh is removable from the distal end.

22. The extractor of claim 21 comprising mesh material in the compartment.

23. A method for removing a cork floating in a bottle, the cork having a long axis, the bottle having a main body and a narrow neck into which the cork can snugly fit, the neck having a long axis, the method comprising the steps of:

a) selecting an extractor comprising:

i) a handle; and ii) at least two generally oval loops depending from the handle and forming a cage into which the cork can fit, the loops comprising an end proximal to the handle and a distal end, the distal ends of the loops being unattached to each other, the loops having substantially the same size and configuration, each loon having a long axis and a short axis and defining a plane, the planes being transverse to each other, the loops having a non-deformed configuration, the short axis of the loops being larger than the diameter of the neck in the non-deformed configuration, the loops being formed of wire sufficiently flexible and sufficiently strong that the loops can be compressed into a deformed configuration that allows their insertion into the bottle through the neck, the loops being formed of wire substantially circular in cross-section;

b) compressing the loops so that the loops can be inserted into the bottle through the neck;

c) inserting the compressed loops into the bottle through the neck;

d) manipulating the loops in the bottle to capture the cork inside the loops with the long axis of the cork generally aligned with the long axis of the neck; and e) pulling on the handle until the cork is removed from the bottle with the loops.

24. A method for removing cork pieces floating in a bottle, the bottle having a main body and a narrow neck, the method comprising the steps of:

a) selecting an extractor comprising:

i) a handle; and ii) at least two generally oval loops depending from the handle and forming a cage into which the cork can fit, the loops comprising an end proximal to the handle and a distal end, the distal ends of the loops being unattached to each other, the loops having substantially the same size and configuration, each loop having a long axis and a short axis and defining a plane, the planes being transverse to each other, the loops having a non-deformed configuration, the short axis of the loops being larger than the diameter of the neck in the non-deformed configuration, the loops being formed of wire sufficiently flexible and sufficiently strong that the loops can be compressed into a deformed configuration that allows their insertion into the bottle through the neck, the loops being formed of wire substantially circular in cross-section;

b) providing flexible mesh in the loops;

c) compressing the loops and the mesh so that the loops and mesh can be inserted into the bottle through the neck;

d) inserting the compressed loops and mesh into the bottle through the neck;

e) manipulating the extractor in the bottle to capture the cork pieces with the mesh; and f) pulling on the handle until the cork pieces are removed from the bottle with the extractor.

25. The extractor of claim 11 wherein each loop is formed of a single strand of wire attached to the handle, and the extractor includes a coil spring around the wire proximal to the handle.

26. The extractor of claim 21 wherein the handle includes a compartment for storing mesh material therein.

* * * * *

UNITED STATES PATENT AND TRADEMARK OFFICE

CERTIFICATE OF CORRECTION

PATENT NO. : 6,240,808 B1
DATED : June 5, 2001
INVENTOR(S) : Gelbard, Martin K.

It is certified that error appears in the above-identified patent and that said Letters Patent is hereby corrected as shown below:

Column 6,
Line 1, "22. The extractor of claim 21" should be -- 23. The extractor of claim 22 --.
Line 1, "23." should be -- 24. --.

Column 7,
Line 1, "24." should be -- 25. --.

Column 8,
Line 1, "25." should be -- 26. --.
Line 1, "26." should be -- 22. --.

Signed and Sealed this

Twenty-third Day of September, 2003

JAMES E. ROGAN
*Director of the United States Patent and Trademark Office*